US008116467B2

(12) United States Patent
Zhang et al.

(10) Patent No.: US 8,116,467 B2
(45) Date of Patent: Feb. 14, 2012

(54) METHOD FOR MANUFACTURING ARRAY MICROPHONES AND SYSTEM FOR CATEGORIZING MICROPHONES

(75) Inventors: Bo Zhang, Nanjing (CN); Lili Chen, Nanjing (CN); Jie Yu, Nanjing (CN)

(73) Assignee: Fortemedia, Inc., Sunnyvale, CA (US)

( * ) Notice: Subject to any disclaimer, the term of this patent is extended or adjusted under 35 U.S.C. 154(b) by 910 days.

(21) Appl. No.: 12/121,066

(22) Filed: May 15, 2008

(65) Prior Publication Data

US 2009/0285405 A1 Nov. 19, 2009

(51) Int. Cl.
*H04R 29/00* (2006.01)

(52) U.S. Cl. ..... 381/58; 381/26; 381/59; 381/92

(58) Field of Classification Search ..... 381/26, 381/58, 59, 92
See application file for complete search history.

(56) References Cited

U.S. PATENT DOCUMENTS

2003/0179890 A1* 9/2003 Matsuo ..... 381/92
2005/0141735 A1* 6/2005 Kim ..... 381/313
2010/0272270 A1* 10/2010 Chaikin et al. ..... 381/59

* cited by examiner

*Primary Examiner* — Wai Sing Louie
(74) *Attorney, Agent, or Firm* — Thomas|Kayden

(57) ABSTRACT

The invention provides a method for manufacturing array microphones. First, signal delays of a plurality of microphones are measured. The microphones are then categorized into a plurality of categories according to the signal delays. A plurality of array microphones are then assembled with a number of component microphones selected from the same categories.

20 Claims, 10 Drawing Sheets

| Category / Delay Range | A | B | C | D |
|---|---|---|---|---|
| Subband1 | Subband2±0.1 | Subband2±0.1 | Subband2±0.1 | Subband2±0.1 |
| Subband2 | (-0.1, 0) | (0.1, 0.2) | (-0.3, -0.2) | (0.3, 0.4) |

FIG. 7A

| Category / Delay Range | A | B | C | D |
|---|---|---|---|---|
| Subband1 | (-0.2, 0.1) | (0, 0.3) | (-0.4, -0.1) | (0.2, 0.5) |
| Subband2 | (-0.1, 0) | (0.1, 0.2) | (-0.3, -0.2) | (0.3, 0.4) |

FIG. 7B

| Category / Delay Range | A1 | A2 | B1 | B2 | C1 | C2 | D1 | D2 |
|---|---|---|---|---|---|---|---|---|
| Subband1 | (-0.3, -0.1) | (0, 0.2) | (-0.1, 0.1) | (0.2, 0.4) | (-0.5, -0.3) | (-0.2, 0.0) | (0.1, 0.3) | (0.4, 0.6) |
| Subband2 | (-0.1, 0) | (-0.1, 0) | (0.1, 0.2) | (0.1, 0.2) | (-0.3, -0.2) | (-0.3, -0.2) | (0.3, 0.4) | (0.3, 0.4) |

FIG. 7C

| Category / Delay Range | A | B | C |
|---|---|---|---|
| Subband1 | (-0.4, 0) | (-0.1, 0.3) | (0.2, 0.6) |
| Subband2 | (-0.3, -0.1) | (0, 0.2) | (0.3, 0.5) |

FIG. 7D

| Category / Delay Range | A1 | A2 | B1 | B2 | C1 | C2 |
|---|---|---|---|---|---|---|
| Subband1 | (-0.5, -0.2) | (-0.1, 0.2) | (-0.2, 0.1) | (0.2, 0.5) | (0.1, 0.4) | (0.5, 0.8) |
| Subband2 | (-0.3, -0.1) | (-0.3, -0.1) | (0, 0.2) | (0, 0.2) | (0.3, 0.5) | (0.3, 0.5) |

FIG. 7E

METHOD FOR MANUFACTURING ARRAY MICROPHONES AND SYSTEM FOR CATEGORIZING MICROPHONES

BACKGROUND OF THE INVENTION

1. Field of the Invention

The invention relates to array microphones, and more particularly to signal delays between component microphones of an array microphone.

2. Description of the Related Art

An array microphone is a device comprising an array of microphones. Referring to FIG. 1, a block diagram of an apparatus 100 comprising an array microphone 110 is shown. When a sound propagates to the array microphone 110, each of the microphones 102 and 103 receives the same sound to respectively generate an audio signal. The array microphone 110 therefore generates a plurality of audio signals $S_1$ and $S_1'$ corresponding to the sound. Because the microphones have a location difference therebetween, the sound propagates to the microphones with different phases, and the audio signals $S_1$ and $S_1'$ have phase difference therebetween due to phase difference of received sounds. After the audio signals $S_1$ and $S_1'$ are amplified and converted from analog to digital to respectively obtain audio signals $S_3$ and $S_3'$, the digital signal processor 108 can generate an audio signal $S_4$ reflecting a sound component coming from a specific direction according to the phase difference between the audio signals $S_3$ and $S_3'$.

The phase difference between the audio signals $S_1$ and $S_1'$ generated by the array microphone 110 are crucial for synthesis of the audio signal $S_4$. The phase difference between the audio signals $S_1$ and $S_1'$ must faithfully reflect the phase difference between the sounds received by the microphones 102 and 103. When the microphones 102 and 103 generate the signals $S_1$ and $S_1'$ with different delay, the delay difference causes the signals $S_1$ and $S_1'$ to have additional phase difference therebetween, referred to as an intrinsic phase difference between the microphones 102 and 103. The intrinsic phase difference is then combined with the phase difference of the received sound to generate audio signals $S_1$ and $S_1'$ with the distorted phase difference, resulting in an erroneously synthesized signal $S_4$ which cannot correctly reflect the sound component coming from the specific direction. Thus, a method for manufacturing an array microphone with smaller intrinsic phase difference between its component microphones is required.

BRIEF SUMMARY OF THE INVENTION

The invention provides a method for manufacturing array microphones. First, signal delays of a plurality of microphones are measured. The microphones are then categorized into a plurality of categories according to the signal delays. A plurality of array microphones are then assembled with a number of component microphones selected from the same categories.

The invention provides a system for categorizing microphones. In one embodiment, the system comprises a front speaker, a sound card, and a computer. Wherein the front speaker, plays a front sound in front of a tested microphone selected from the microphones to be categorized and a reference microphone. The sound card then records a tested signal generated by the tested microphone in response to the front sound and a reference signal generated by the reference microphone in response to the front sound. Finally, the computer calculates a signal delay between the tested signal and the reference signal, and classifies the tested microphone as one of a plurality of categories according to the signal delay.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein:

FIGS. 7A~7E respectively show embodiments of delay ranges corresponding to the categories according to the invention.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
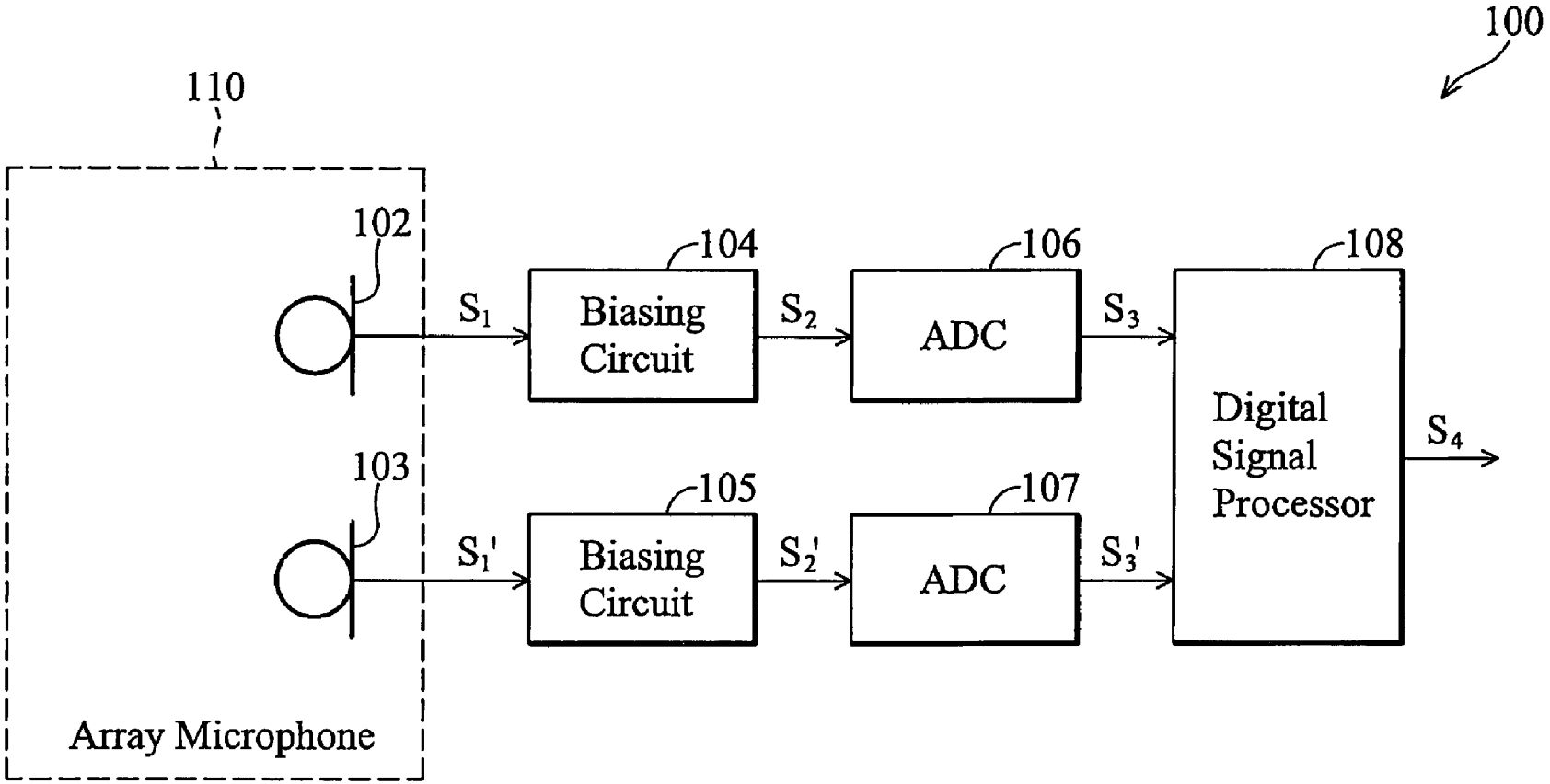
FIG. 1 ( PRIOR ART )
FIG. 1 is a block diagram of an apparatus comprising an array microphone.
Figure 2:
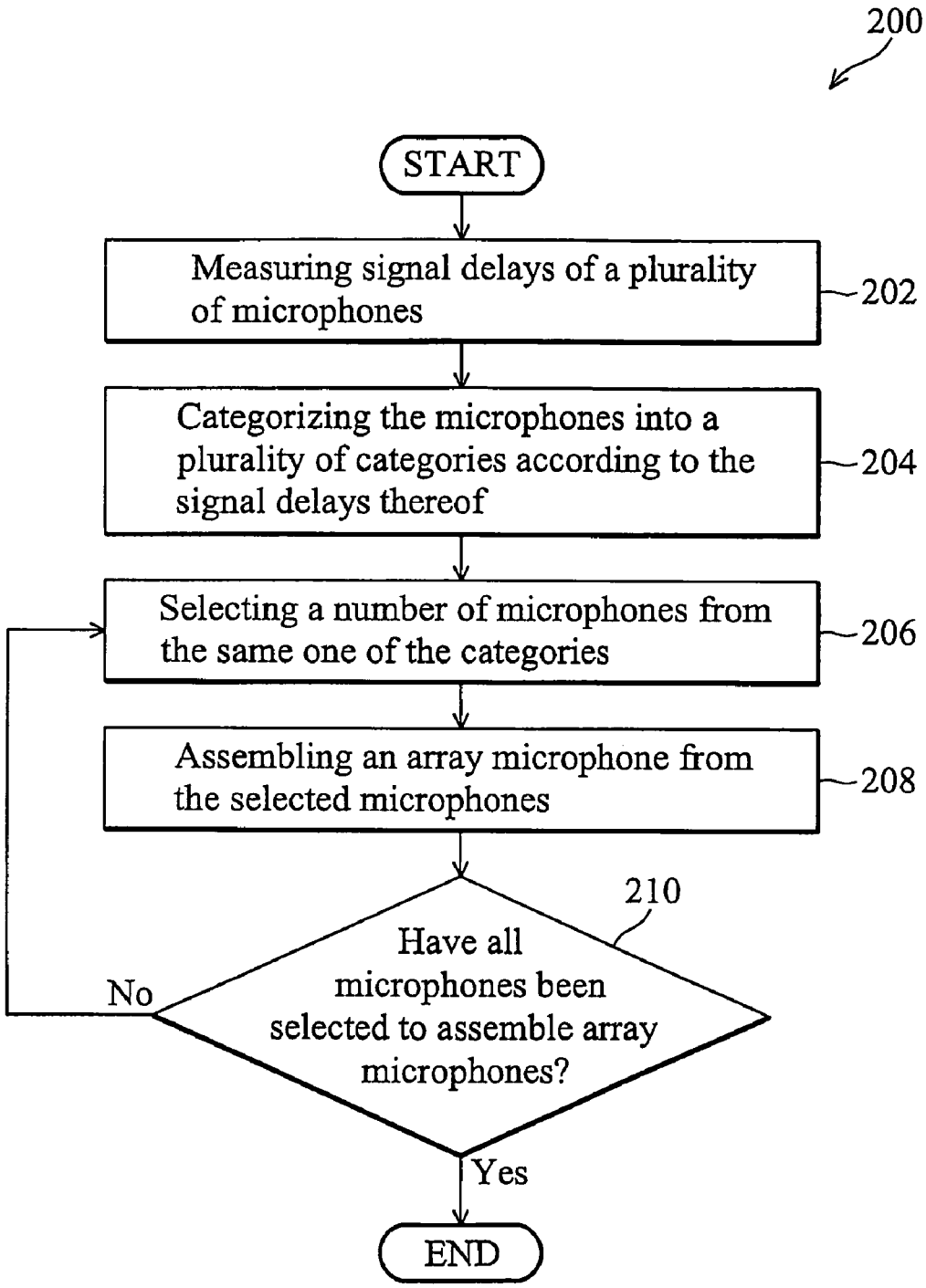
FIG. 2 is a flowchart of a method for manufacturing an array microphone with small intrinsic phase difference between component microphones thereof according to the invention.

Referring to FIG. 2, a flowchart of a method 200 for manufacturing an array microphone with small intrinsic phase difference between component microphones thereof according to the invention is shown. First, signal delays of a plurality of microphones are measured (step 202). In one embodiment, the microphones are omni-directional microphones. The microphones are then categorized into a plurality of categories according to the signal delays thereof (step 204). For example, microphones with similar signal delays are categorized as the same category. After the microphones are categorized, microphones belonging to the same category therefore have similar signal delays. To fabricate an array microphone, a number of component microphones are first selected from the same categories (step 206), and the selected component microphones are gathered to assemble the array microphone (step 208). Because the component microphones are selected from the same category and have almost equal signal delays, the delay difference or phase difference between the component microphones are small. Thus, one array microphone with a small phase difference is obtained, and other microphones can be repeatedly fabricated according to steps 206 and 208 until all microphones are exhausted (step 210).

Figure 3A:
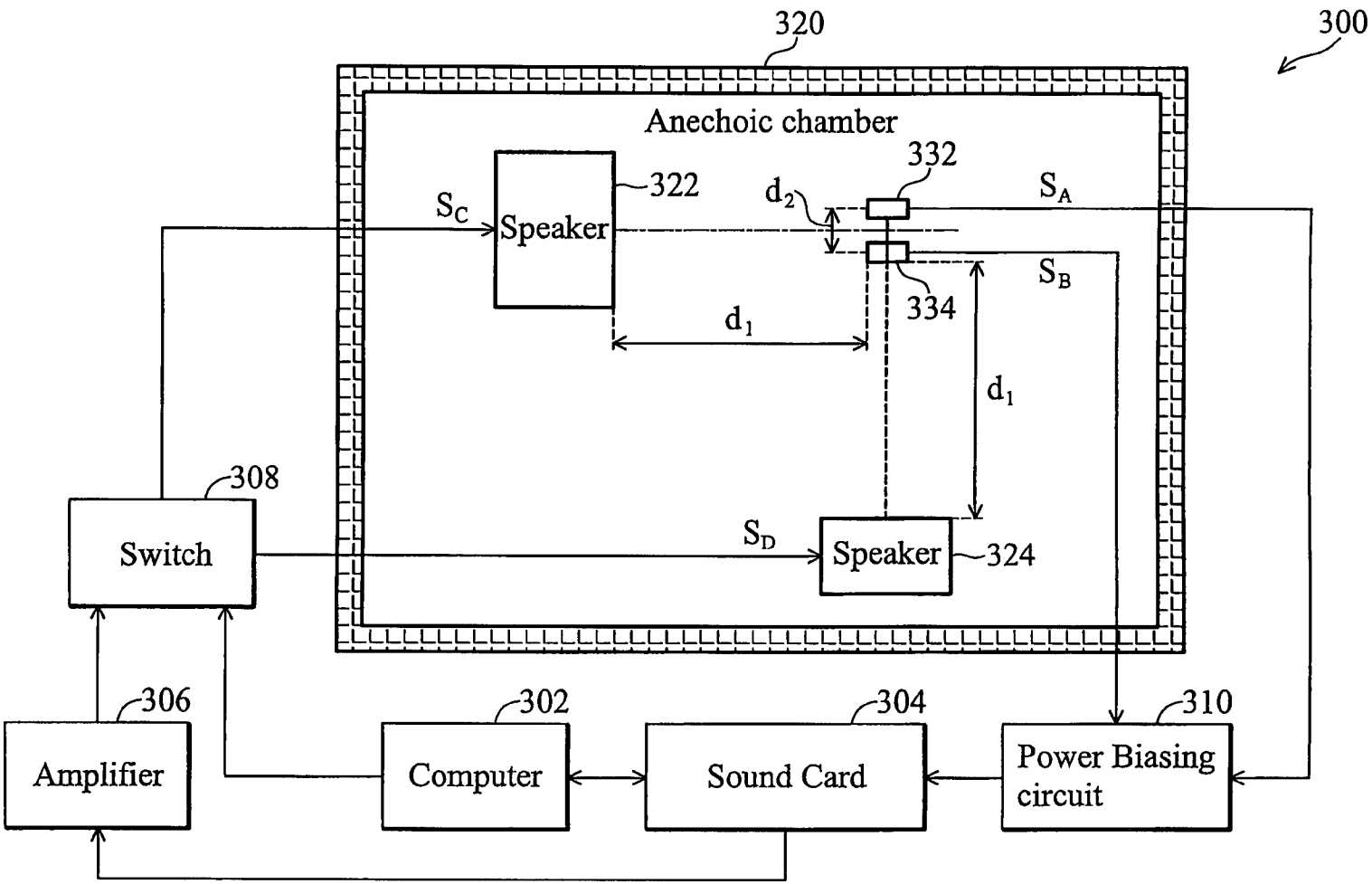
FIG. 3A is a block diagram of a system categorizing microphones according to the invention.

Referring to FIG. 3A, a block diagram of a system 300 categorizing microphones according to the invention is shown. The system 300 comprises a computer 302, a sound card 304, an amplifier 306, a switch 308, a power biasing circuit 310, and an anechoic chamber 320. Inside the anechoic chamber 320 are a front speaker 322, a side speaker 324, a reference microphone 332, and a tested microphone 334. The front speaker 322 is placed in front of the reference microphone 332 and the tested microphone 334 and at the same distance $d_1$ from the reference microphone 332 and the tested microphone 334. In one embodiment, the distance $d_1$ is 20 cm, and the distance $d_2$ between the reference microphone 332 and the tested microphone 334 is 10.5 mm. The side speaker 324 is placed at a lateral angle from the reference microphone 332 and the tested microphone 334. In one embodiment, the side speaker 324 is at distance equal to the distance $d_1$ from the reference microphone 332 and the tested microphone 334.

Figure 3B:
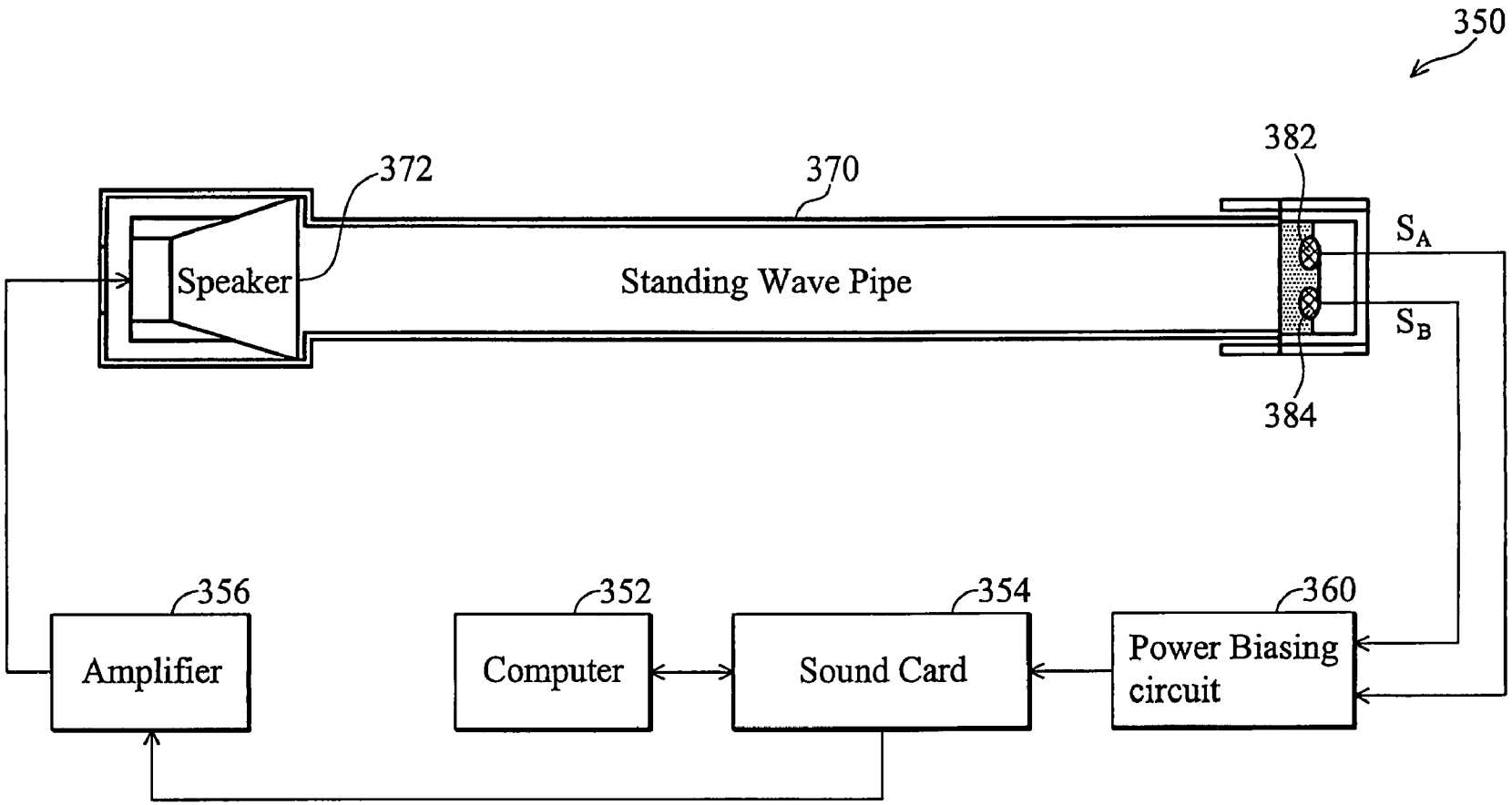
FIG. 3B is a block diagram of another system categorizing microphones according to the invention.

The computer 302 is a core of the system 300 and controls the sound card 304 and the switch 308. The power biasing circuit 310 provides the two microphones 332 and 334 with operating voltages. The two microphones 332 and 334 are coupled to two receiving channels of the sound card 304. Thus, the sound card 304 can record the audio signals $S_A$ and $S_B$ generated by the reference microphone 332 and the tested microphone 334. In addition, the sound card 304 can also play a sound signal. After the amplifier 306 amplifies the sound signal, the computer 302 controls the switch 308 to pass the sound signal to the front speaker 322 or the side speaker 324. The front speaker 322 then plays the sound signal $S_C$ as a front sound in front of the microphones 332 and 334. Otherwise, the side speaker 324 plays the sound signal $S_D$ as a side sound. Referring to FIG. 3B, a block diagram of another system 350 categorizing microphones according to the invention is shown. The system 350 is almost the same as the system 300 except for the anechoic chamber 320 is replaced with a standing wave pipe 370 in which there is only one front speaker 372. No side speaker is in the standing wave pipe 370 of FIG. 3B, and the switch 308 is therefore removed from the system 350. Because the system 350 is roughly the same as the system 300, the following embodiments of the invention are illustrated with the system 330.

Figure 4:
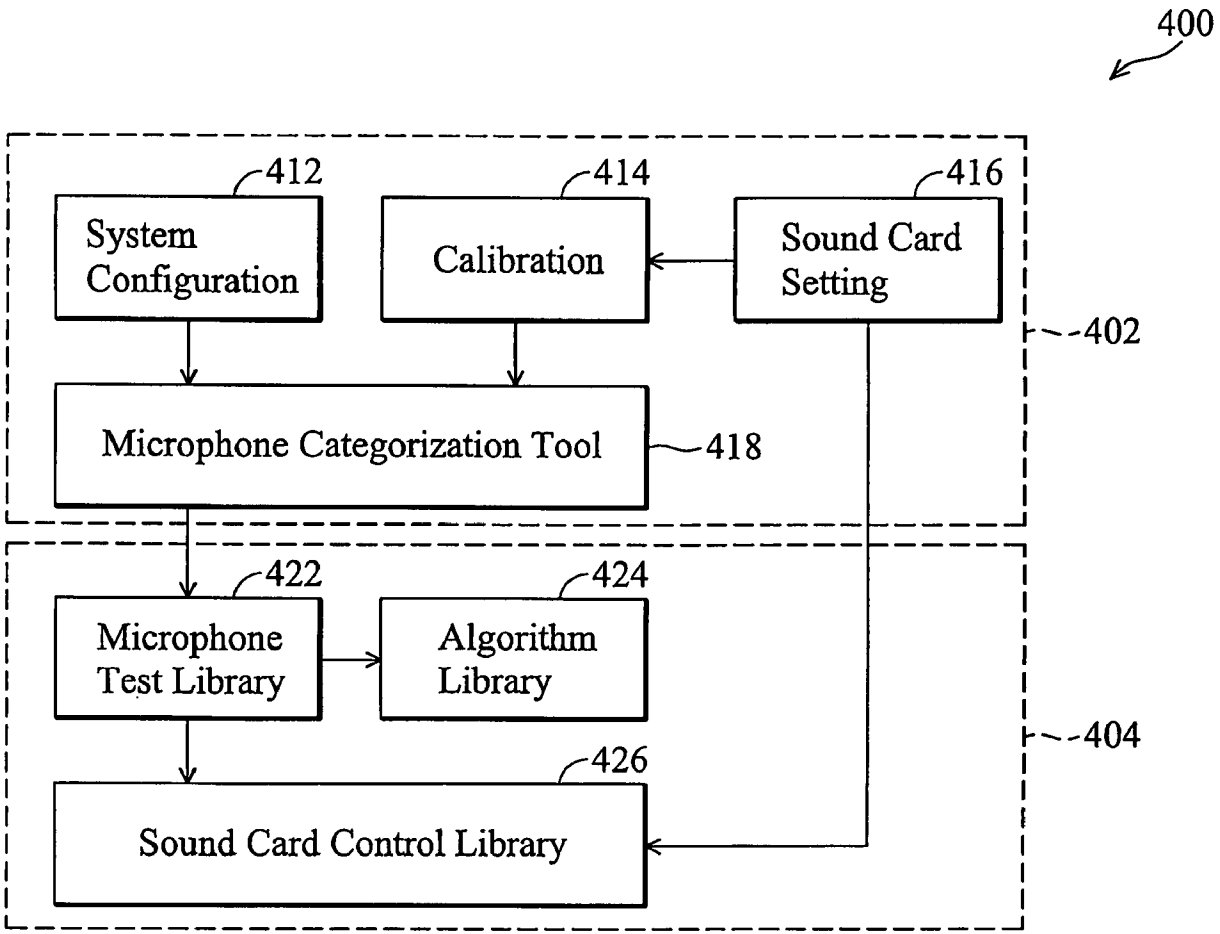
FIG. 4 is a schematic diagram of a software structure of the computer of FIG. 3A.

Referring to FIG. 4, a schematic diagram of a software structure of the computer 302 of FIG. 3A is shown. The software 400 of the computer 302 comprises a high level software 402 and a low level software 404. The high level software 402 comprises a system configuration unit 412, a calibration unit 414, a sound card setting unit 416, and a microphone categorization tool 418. The low level software 404 comprises a microphone test library 422, an algorithm library 424, and a sound card control library 426. The system 300 may comprise multiple sound cards 304, and the system configuration unit 412 is responsible for selecting a sound card 304 for signal recording and selecting a sound card 304 for sound playing. The calibration unit 414 is responsible for start-up calibration. The sound card setting unit 416 stores sound card settings. The microphone categorization tool 418 then classifies the tested microphone 334 as one of the categories with the low level software 404. In addition, the microphone categorization tool 418 is a user interface for showing categorization result.

Figure 5:
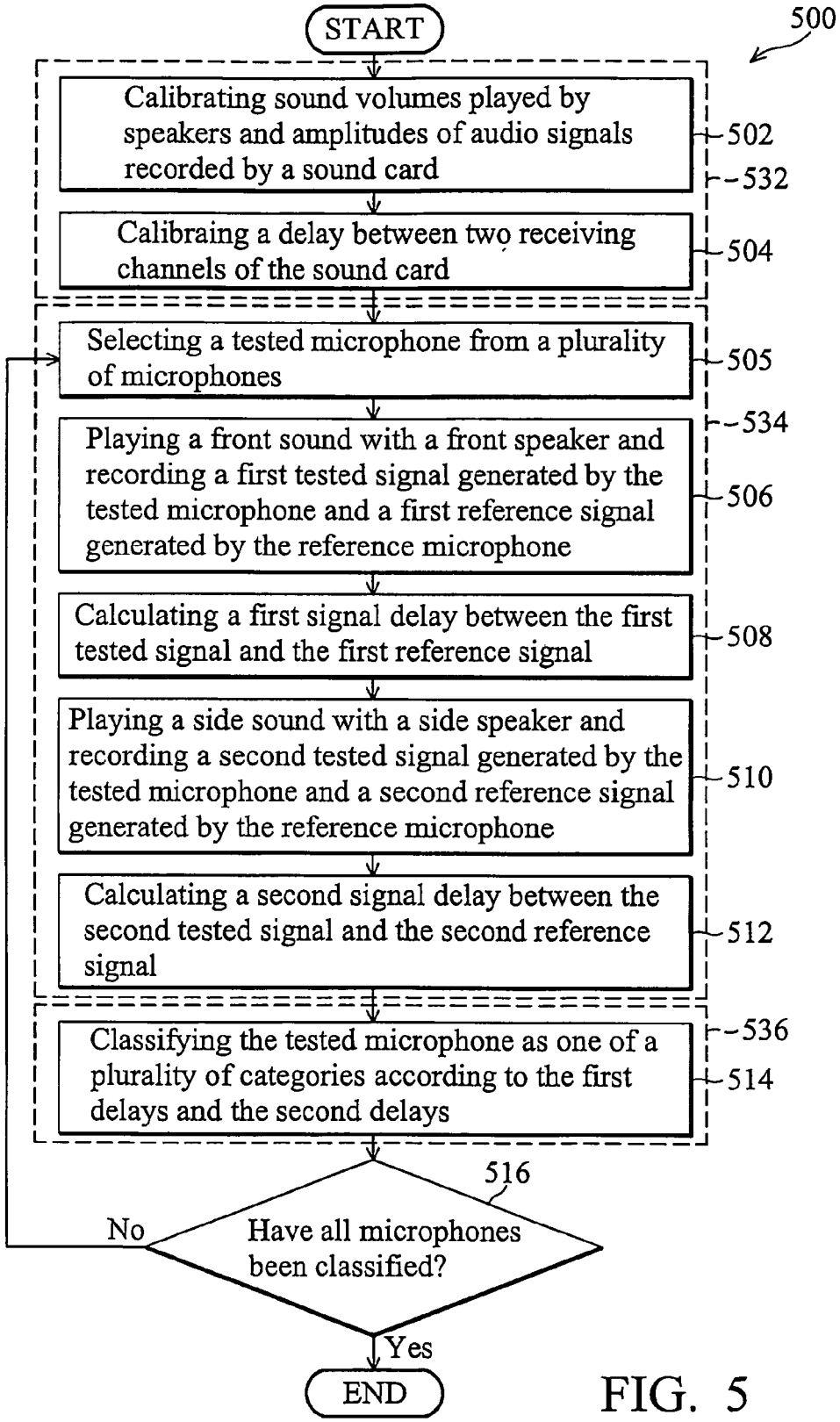
FIG. 5 is a flowchart of a method for categorizing a plurality of microphones according to the invention.

Referring to FIG. 5, a flowchart of a method 500 for categorizing a plurality of microphones according to the invention is shown. The system 300 categorizes the microphones into a plurality of categories according the method 500. The method 500 is divided into a calibration stage 532 comprising steps 502 and 504, a measurement stage 534 comprising steps 505~512, and a categorization stage comprising step 514. First, the computer 302 calibrates sound volumes played by the front speaker 322 and the side speaker 324 to a standard volume (step 502). In addition, because the tested microphone 334 and the reference microphone 332 are respectively coupled to one receiving channel of the sound card 304, the computer 302 calibrates an intrinsic signal delay between the two recording channels of the sound card 304 (step 504). The signal delay between the two receiving channels therefore does not affect the categorization result after calibration.

A user then selects a tested microphone 332 from a plurality of microphones (step 505) and installs the tested microphone 332 in the anechoic chamber 320 as shown in FIG. 3A. The computer 302 then controls the sound card 304 to generate a sound signal $S_C$ passed to the front speaker 322, which then plays the sound signal $S_C$ as a front sound (step 506). The reference microphone 332 and the tested microphone 334 then respectively generate audio signals $S_A$ and $S_B$ in response to the front sound. The sound card 304 then records the audio signals $S_A$ and $S_B$ as a reference signal and a tested signal and passes the recorded signals to the computer 302 (step 506). The computer 302 then calculates a first signal delay between the tested signal and the reference signal (step 508). Thus, a signal delay corresponding to the tested microphone 334 is obtained.

In one embodiment, the computer 302 calculates the first signal delay corresponding to the tested microphone 334 on the basis of a sub-band analysis. The computer 302 first filters the tested signal with a set of filters with un-overlapping pass-bands to obtain sub-band components of the tested signal. In one embodiment, the pass-bands of the filters are a first sub-band $SB_1$ with a frequency range from 120~500 Hz, a second sub-band $SB_2$ with a frequency range from 500~1800 Hz, a third sub-band $SB_3$ with a frequency range from 1800~4 kHz, and a fourth sub-band $SB_4$ with a frequency range from 4 k~8 kHz. The computer 302 then filters the reference signal with the same set of filters to obtain sub-band components of the reference signal. The sub-band components of the tested signal are then respectively compared with corresponding sub-band components of the reference signal to obtain a set of sub-band delays $D_1$, $D_2$, $D_3$, and $D_4$, wherein the sub-band delays $D_1$, $D_2$, $D_3$, and $D_4$ respectively correspond to the sub-bands $SB_1$, $SB_2$, $SB_3$, and $SB_4$.

The computer 302 then controls the sound card 304 to generate a sound signal $S_D$ passed to the side speaker 324, which then plays the sound signal $S_D$ as a side sound (step 510). The reference microphone 332 and the tested microphone 334 then respectively generate audio signals $S_A$ and $S_B$ in response to the side sound. The sound card 304 then records the audio signals $S_A$ and $S_B$ as a second reference signal and a second tested signal and passes the recorded signals to the computer 302 (step 510). The computer 302 then calculates a second signal delay between the second tested signal and the second reference signal (step 512). In one embodiment, the computer 302 calculates the second signal delay corresponding to the tested microphone 334 on the basis of a sub-band analysis. Thus, another set of sub-band delays $D_1'$, $D_2'$, $D_3'$, and $D_4'$ respectively corresponding to the sub-bands $SB_1$, $SB_2$, $SB_3$, and $SB_4$ are obtained.

After the first signal delay and the second signal delay is calculated, the computer classifies the tested microphone as one of the plurality of categories according to the first signal delay and the second signal delay (step 514). In one embodiment, each of the categories has a corresponding delay range defining a range of the signal delay of the tested microphone. The computer 302 then compares the measured signal delay with the plurality of delay ranges corresponding to the categories. When the measured signal delay meets the delay range corresponding to a target category selected from the categories, the computer 302 classifies the tested microphone as the target category. Another microphone is then selected from the microphones as a next tested microphone to replace the current tested microphone until all microphones has been classified (step 516). Thus, all microphones are classified and can be used to assemble array microphones in steps 206 and 208 of the method 200.

Figure 6:
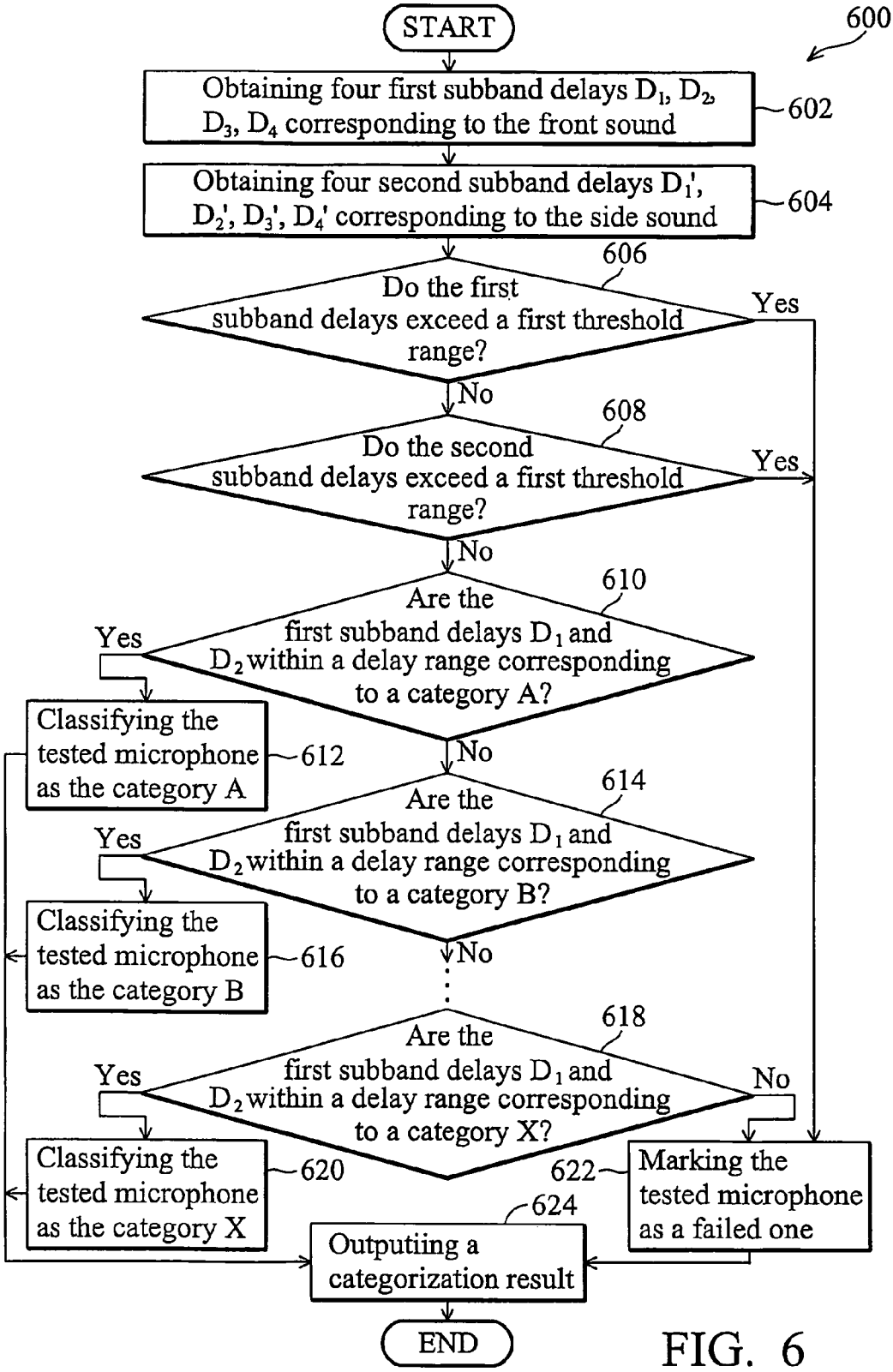
FIG. 6 is a flowchart of a method for classifying a tested microphone according to the invention.

In one embodiment, the first signal delay of the tested microphone comprises a set of sub-band delays $D_1$, $D_2$, $D_3$, and $D_4$ respectively corresponding to the sub-bands $SB_1$, $SB_2$, $SB_3$, and $SB_4$, and the second signal delay of the tested microphone comprises a set of sub-band delays $D_1'$, $D_2'$, $D_3'$, and $D_4'$ respectively corresponding to the sub-bands $SB_1$, $SB_2$, $SB_3$, and $SB_4$. The computer 302 can then classify the tested microphone according to the sub-band delays $D_1$, $D_2$, $D_3$, and $D_4$. Referring to FIG. 6, a flowchart of a method 600 for classifying a tested microphone according to the invention is shown. The first sub-band delays $D_1$, $D_2$, $D_3$, and $D_4$ and second sub-band delays $D_1'$, $D_2'$, $D_3'$, and $D_4'$ are first respectively obtained in steps 602 and 604. The computer 302 then compares the first sub-band delays with a first threshold range (step 606). If first sub-band delays exceed the first threshold range, the tested microphone is marked as a failed one, which is abandoned and not used for assembling an array microphone (step 622). Accordingly, the computer 302 also compares the second sub-band delays with a second threshold range (step 608). If second sub-band delays exceed the second threshold range, the tested microphone is abandoned and not used for assembling an array microphone (step 622).

The computer 302 then compares the sub-band delays $D_1$, $D_2$, $D_3$, and $D_4$ with the plurality of delay ranges corresponding to the categories. In one embodiment, the delay ranges are defined according to the first sub-band $SB_1$ and the second sub-band $SB_2$, and only the sub-band delays $D_1$ and $D_2$ are therefore compared. Referring to FIGS. 7A~7E, embodiments of delay ranges corresponding to the categories according to the invention are shown. The delay ranges have a unit of a sampling period. Taking the embodiment of FIG. 7B for example, the microphones are categorized into categories A, B, C, and D. The computer 302 first compares the measured sub-band delays $D_1$ and $D_2$ with the delay range corresponding to the category A (step 610). The delay range corresponding to the sub-band $SB_1$ is (−0.2, 0.1), and the delay range corresponding to the sub-band $SB_2$ is (−0.1, 0). If the sub-band delay $D_1$ is within the delay range (−0.2, 0.1) and the sub-band delay $D_2$ is within the delay range (−0.1, 0), the tested microphone is classified as the category A (step 612). Otherwise, the measured sub-band delays $D_1$ and $D_2$ are compared with delay ranges of other categories until a target category is found. Finally, the categorization result is shown on a screen of the computer 302 to notify the user.

The invention provides a method for manufacturing array microphones. Signal delays of microphones are first measured. The microphones are then categorized into a plurality of categories according to the measured signal delays, wherein microphones of one category have similar signal delays. Component microphones of an array microphone are then selected from the same category. Thus, a delay difference or a phase difference between the component microphones of the array microphone is small to improve the performance of the array microphone.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for manufacturing array microphones, comprising:

measuring signal delays of a plurality of microphones;

categorizing the microphones into a plurality of categories according to the signal delays; and respectively assembling a plurality of array microphone with a number of component microphones selected from the same categories.

2. The method as claimed in claim 1, wherein the measurement of the signal delays comprises:

selecting a tested microphone from the microphones;

playing a front sound in front of the tested microphone and a reference microphone;

recording a tested signal generated by the tested microphone in response to the front sound and a reference signal generated by the reference microphone in response to the front sound; and calculating a signal delay between the tested signal and the reference signal.

3. The method as claimed in claim 2, wherein the calculation of the signal delay comprises:

retrieving a plurality of first sub-band components from the tested signal;

retrieving a plurality of second sub-band components from the reference signal; and comparing the first sub-band components with the second sub-band components to obtain a set of sub-band delays between the first sub-band components and the second sub-band components.

4. The method as claimed in claim 3, wherein retrieving of the first sub-band components comprises respectively filtering the tested signal with a plurality of filters with un-overlapping pass-bands to obtain the first sub-band components, and retrieving of the second sub-band components comprises respectively filtering the reference signal with the filters to obtain the second sub-band components.

5. The method as claimed in claim 2, wherein the measurement of the signal delays further comprises:

playing a side sound at a lateral angle from the tested microphone and the reference microphone; and recording a second tested signal generated by the tested microphone in response to the side sound and a second reference signal generated by the reference microphone in response to the side sound; and calculating a second signal delay between the second tested signal and the second reference signal.

6. The method as claimed in claim 2, wherein the categorization of the microphones comprises:

comparing the signal delay corresponding to the tested microphone with a plurality of delay ranges corresponding to the plurality of categories; and classifying the tested microphone as a target category when the signal delay corresponding to the tested microphone meets the delay range corresponding to the target category selected from the categories.

7. The method as claimed in claim 2, wherein the categorization of the microphones comprises marking the tested microphone as a failed one when the signal delay corresponding to the tested microphone exceeds a first threshold range.

8. The method as claimed in claim 5, wherein the categorization of the microphones comprises marking the tested microphone as a failed one when the second signal delay corresponding to the tested microphone exceeds a second threshold range.

9. The method as claimed in claim 3, wherein the categorization of the microphones comprises:

comparing the sub-band delays corresponding to the tested microphone with a plurality of delay ranges corresponding to the plurality of categories; and classifying the tested microphone as a target category when the sub-band delays corresponding to the tested microphone meet the delay range corresponding to the target category selected from the categories.

10. The method as claimed in claim 1, wherein the microphones are omni-directional microphones.

11. A system for categorizing microphones, the system comprising:

a front speaker, playing a front sound in front of the tested microphone selected from the microphones to be categorized and a reference microphone;

a sound card, recording a tested signal generated by the tested microphone in response to the front sound and a reference signal generated by the reference microphone in response to the front sound; and a computer, calculating a signal delay between the tested signal and the reference signal, and classifying the tested microphone as one of a plurality of categories according to the signal delay.

12. The system as claimed in claim 11, wherein the tested microphone are repeatedly changed until all signal delays between the microphones and the reference microphone are measured, thereby categorizing the microphones into the plurality of categories according to the signal delays corresponding to the microphones, and a plurality of array microphones are respectively assembled with a number of component microphones selected from the same categories.

13. The system as claimed in claim 11, wherein the computer retrieves a plurality of first sub-band components from the tested signal, retrieves a plurality of second sub-band components from the reference signal, and compares the first sub-band components with the second sub-band components to obtain a set of sub-band delays between the first sub-band components and the second sub-band components, thereby calculating the signal delay corresponding to the tested microphone.

14. The system as claimed in claim 13, wherein the computer respectively filters the tested signal with a plurality of filters with un-overlapping pass-bands to obtain the first sub-band components, and respectively filters the reference signal with the filters to obtain the second sub-band components.

15. The system as claimed in claim 11, wherein the system further comprises a side speaker playing a side sound at a lateral angle from the tested microphone and the reference microphone, the sound card then records a second tested signal generated by the tested microphone in response to the side sound and a second reference signal generated by the reference microphone in response to the side sound, and the computer then calculates a second signal delay between the second tested signal and the second reference signal.

16. The system as claimed in claim 11, wherein the computer compares the signal delay corresponding to the tested microphone with a plurality of delay ranges corresponding to the plurality of categories, and classifies the tested microphone as a target category when the signal delay corresponding to the tested microphone meets the delay range corresponding to the target category selected from the categories, thereby classifying the tested microphone.

17. The system as claimed in claim 11, wherein the computer marks the tested microphone as a failed one when the signal delay corresponding to the tested microphone exceeds a first threshold range.

18. The system as claimed in claim 15, wherein the computer marks the tested microphone as a failed one when the second signal delay corresponding to the tested microphone exceeds a second threshold range.

19. The system as claimed in claim 13, wherein the computer compares the sub-band delays corresponding to the tested microphone with a plurality of delay ranges corresponding to a plurality of categories, and classifies the tested microphone as a target category when the sub-band delays corresponding to the tested microphone meet the delay range corresponding to the target category selected from the categories, thereby classifying the tested microphone.

20. The system as claimed in claim 12, wherein the microphones are omni-directional microphones.

* * * * *